US006811095B2

(12) United States Patent
Donley et al.

(10) Patent No.: US 6,811,095 B2
(45) Date of Patent: Nov. 2, 2004

(54) ALL PLASTIC AIR CAP FOR HOT MELT ADHESIVE APPLICATOR

(75) Inventors: Paul J. Donley, Hendersonville, TN (US); Daniel D. Bourget, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 344 days.

(21) Appl. No.: 10/036,450

(22) Filed: Jan. 7, 2002

(65) Prior Publication Data

US 2003/0127536 A1 Jul. 10, 2003

(51) Int. Cl.[7] ..... B05B 1/28

(52) U.S. Cl. ..... 239/290; 239/291; 239/292; 239/294; 239/296

(58) Field of Search ..... 239/290, 291, 239/292, 294, 296, 298, 301

(56) References Cited

U.S. PATENT DOCUMENTS

| | | | | | |
|---|---|---|---|---|---|
| 4,785,996 | A | | 11/1988 | Ziecker et al. | |
| 4,891,249 | A | * | 1/1990 | McIntyre | 239/291 |
| 4,995,333 | A | * | 2/1991 | Keller et al. | 239/290 |
| 5,020,723 | A | * | 6/1991 | Crist | 239/292 |
| 5,292,068 | A | | 3/1994 | Raterman et al. | |
| 5,536,583 | A | * | 7/1996 | Roberts et al. | 428/457 |
| 6,012,647 | A | * | 1/2000 | Ruta et al. | 239/132.1 |
| 6,045,135 | A | * | 4/2000 | Feistel | 277/434 |
| 6,149,076 | A | | 11/2000 | Riney | |
| 6,170,759 | B1 | * | 1/2001 | Meyer | 239/298 |
| 6,460,787 | B1 | * | 10/2002 | Hartle et al. | 239/691 |
| 6,669,057 | B2 | * | 12/2003 | Saidman et al. | 239/135 |

* cited by examiner

*Primary Examiner*—Robin O. Evans
(74) *Attorney, Agent, or Firm*—Schwartz & Weinrieb

(57) ABSTRACT

A new and improved hot melt adhesive applicator nozzle assembly comprises an adapter, a dispensing nozzle mounted within the adapter, a nozzle retainer threadedly engaged with the adapter for securing the dispensing nozzle within the adapter, an air inlet ring rotatably mounted upon the nozzle retainer and having an inlet air fitting fixedly mounted therein, and an end cap which is threadedly mounted upon the nozzle retainer. The end cap has swirl air passages integrally incorporated therein, and the end cap and air inlet ring are both fabricated from a suitable thermoplastic polymer material such that all exposed surfaces of the hot melt adhesive applicator nozzle assembly are plastic and are therefore at substantially lower temperature levels than the metal brass components of the hot melt adhesive applicator nozzle assembly. The external peripheral surface of the end cap is knurled so as to facilitate the manual removal of the end cap without the need for special tools, and most importantly, the dispensing tip portion of the dispensing nozzle is axially recessed with respect to the front surface of the end cap so as not to comprise a readily externally accessible surface portion. In this manner, the potential for burn and safety hazards to operator personnel has effectively been eliminated.

22 Claims, 4 Drawing Sheets

ALL PLASTIC AIR CAP FOR HOT MELT ADHESIVE APPLICATOR

FIELD OF THE INVENTION

The present invention relates generally to hot melt adhesive applicators, and more particularly to a new and improved air cap for hot melt adhesive applicators wherein the new and improved air cap of the present invention is fabricated from a polymer plastic, the new and improved air cap of the present invention is adapted to be threadedly engaged upon the forward end portion of the hot melt adhesive applicator nozzle assembly so as to render the mounting and dismounting of air cap components upon the nozzle assembly relatively quick and easy, and the forward end tip portion of the hot melt adhesive applicator dispensing nozzle is effectively disposed at an axially recessed position within the new and improved air cap of the present invention so as not to present a burn hazard to operator personnel when mounting and dismounting air cap components upon the hot melt adhesive applicator nozzle assembly in accordance with air cap replacement or exchange operations attendant maintenance procedures or the implementation of different hot melt adhesive deposition patterns.

BACKGROUND OF THE INVENTION

Different structural arrangements of the various component parts of hot melt adhesive applicator nozzle assemblies are of course well-known in the art and industry. For example, a first well-known, conventional PRIOR ART hot melt adhesive applicator nozzle assembly is disclosed within FIGS. 1 and 2 and is generally indicated by the reference character 10. The assembly 10 is seen to comprise a tubular hot melt adhesive dispensing nozzle 12 having a discharge port 14 at the downstream end thereof, while the upstream end thereof is seated within a counterbored section 16 of a first downstream axially extending tubular portion 18 of a hot melt adhesive nozzle adapter 20. A second upstream axially extending tubular portion 22 of the nozzle adapter 20 is externally threaded as at 24 so as to facilitate the mounting of the hot melt adhesive applicator nozzle assembly 10 upon a hot melt adhesive applicator gun or similar dispensing implement, not shown, and it is seen that the nozzle adapter 20 and dispensing nozzle 12 are coaxially disposed with respect to each other so as together define an axial passageway 26 through which adhesive material is able to be conducted to the dispensing nozzle discharge port 14. An O-ring 28 is disposed within an annularly recessed region 30, defined within the upstream end portion of the dispensing nozzle 12, so as to interact in a fluid-tight manner with the inner peripheral surface portion 32 of the first downstream axially extending tubular portion 18 of the hot melt adhesive nozzle adapter 20. An intermediate axial portion of the dispensing nozzle 12 is provided with an annular shoulder portion 34 upon the external peripheral surface thereof, and a radially inwardly projecting annular flanged portion 36 of a nozzle retainer 38 is adapted to be engaged with the shoulder portion 34 of the dispensing nozzle 12 so as to fixedly retain the dispensing nozzle 12 at its seated position within the nozzle adapter 20. In order to achieve such fixation of the dispensing nozzle 12, an internally threaded, upstream end portion 40 of the nozzle retainer 38 is threadedly mated with an externally threaded surface portion 42 of the first downstream axially extending tubular portion 18 of the hot melt adhesive nozzle adapter 20.

As can best be appreciated from FIG. 1, the nozzle retainer 38 is provided with three, equiangularly, circumferentially spaced, radially oriented ports 44, and an air fitting 46, for supplying swirl air to be used in conjunction with the dispensed hot melt adhesive material, is adapted to be fixedly mated with a selected one of the ports 44, depending upon spatial orientations or uses of the hot melt adhesive applicator nozzle assembly 10, while a pair of plugs 48, 48 are fixedly retained within the other two ports 44 within which the air fitting 46 is not fixedly disposed. Dispensing nozzle 12 is conventionally fabricated from a suitable brass composition, and the temperature internally of the dispensing nozzle 12 is conventionally within the range of 300–400° F. In order to therefore prevent the undesirable premature cooling of the dispensing nozzle 12, an annular stainless steel baffle 50 is radially interposed between the air inlet ports 44 and the outer peripheral surface of the dispensing nozzle 12 so as to prevent the impingement of the incoming air onto the outer peripheral surface of the dispensing nozzle 12 and to conduct the incoming air toward the downstream dispensing tip portion of the dispensing nozzle 12. It is seen that the upstream end of the baffle member 50 is axially seated upon the radially inwardly projecting annular flanged portion 36 of the nozzle retainer 38, and in order to retain the baffle member 50 fixedly disposed at such axial position, the forward end of the hot melt adhesive applicator nozzle assembly 10 is further provided with an end cap 52 which has a substantially C-shaped cross-sectional configuration and is also fabricated from a suitable brass composition.

An inner peripheral annular surface portion of the axially upstream end portion of the end cap 52 is threaded as at 54, and an outer peripheral annular surface portion of the axially downstream end portion of the nozzle retainer 38 is also threaded as at 56. In this manner, when the end cap 52 is threadedly mated with and fully seated upon the nozzle retainer 38, the radially inner, axially downstream portion 58 of the end cap 52 is seated upon the dispensing tip portion of the dispensing nozzle 12 whereby the baffle member 50 is axially retained between the radially inner portion 58 of the end cap 52 and the radially inwardly projecting annular flanged portion 36 of the nozzle retainer 38. It is further seen that the radially inner portion 58 of the end cap 52, through which the dispensing tip portion of the dispensing nozzle 12 projects, is provided with a plurality of substantially axially oriented air passageways 60 through means of which the swirl air, as conducted into the hot melt adhesive applicator nozzle assembly 10 by means of the air fitting 46 and as effectively deflected by means of the baffle member 50, can be provided in conjunction with the dispensed hot melt adhesive material so as to affect or control the deposition pattern of the dispensed hot melt adhesive material. Still further, it is also noted that the external periphery of the end cap 52 has a substantially hexagonal configuration as may best be appreciated from FIG. 1.

While the aforenoted hot melt adhesive applicator nozzle assembly 10 has been commercially successful, such an assembly 10 nevertheless exhibits some operational drawbacks from both operational efficiency and personnel safety points of view. For example, it is known in the industry that those structures or components having the swirl air passageways or ports defined therein require periodic maintenance, comprising either replacement of the structures or components or a cleaning of the same, due to the tendency of the swirl air passageways or ports to become clogged or blocked. Alternatively, the structures or components having the swirl air passageways or ports defined therein are desirably replaced so as to alter the particular deposition patterns of the dispensed hot melt adhesive material as affected or controlled by means of the swirl air passageways or ports. In connection with a hot melt adhesive applicator nozzle assembly such as that disclosed at 10 within FIGS. 1 and 2, in view of the fact that the end cap 52 is fabricated from a suitable brass composition, the end cap 52 becomes extremely hot thereby necessitating the removal of the same from the assembly 10 by means of a special tool which can grasp the hexagonally shaped end cap 52. In addition, the presence of such a component at the aforenoted elevated temperature level, as well as the axial projection of the tip portion of the dispensing nozzle 12 beyond the front planar surface of the end cap 52, wherein the tip portion of the dispensing nozzle 12 is likewise characterized by means of the aforenoted elevated temperature level, presents a potential burn or safety hazard with respect to operator personnel. Still further, the provision of the three different air ports to which the air fitting can be fluidically connected, while plug components must be installed with respect to the remaining air ports, comprises cumbersome installation and operational procedures.

With reference now being made to FIGS. 3 and 4, a second well-known conventional PRIOR ART hot melt adhesive applicator nozzle assembly is disclosed and is generally indicated by the reference character 110. It is to be noted that in view of the fact that the second nozzle assembly 110 comprises structural components which are similar to those of the first nozzle assembly 10, such similar or corresponding structural components will be designated by corresponding reference characters except for the fact that the reference characters will be within the 100 series. Furthermore, in view of the similarities between the first and second well-known conventional PRIOR ART hot melt adhesive dispensing nozzle assemblies 10, 110, only those structural features of the nozzle assembly 110 which are significantly different from those of the nozzle assembly 10 will be discussed in detail. It is initially seen, for example, that in lieu of separate dispensing nozzle 12 and nozzle adapter 20 components as was characteristic of the hot melt adhesive applicator nozzle assembly 10, the hot melt adhesive applicator nozzle assembly 110 comprises, in effect, a single structural component which effectively serves the purposes of both the dispensing nozzle 12 and nozzle adapter 20 components of the first hot melt adhesive applicator nozzle assembly 10. More particularly, it is seen that tubular dispensing nozzle 112 defines an axial passageway 126 through which adhesive material is conducted, a downstream tip portion within which a hot melt adhesive discharge port 114 is defined, and an upstream end portion which is externally threaded as at 124 so as to facilitate the mounting of the hot melt adhesive applicator nozzle assembly 110 upon a hot melt adhesive applicator gun or similar implement.

An annular recess 162 is defined within an external peripheral portion of the dispensing nozzle 112 at a substantially axial central portion thereof, and a plurality of axially extending air passageways 164 are defined within that portion of the dispensing nozzle 112 located downstream of the annular recess 162 such that the air passageways are fluidically connected at their upstream ends to the annular recess 162. An air fitting 146, mounted within an annular air fitting ring member 166, is adapted to be fluidically connected to the annular recess 162 so as to convey a supply of incoming air thereto. The air fitting ring member 166 is adapted to be movably mounted in a rotatable manner upon the axially central external portion of the dispensing nozzle 112 such that the particular angular orientation of the air fitting 146 may be varied as needed, and in this manner, the hot melt adhesive applicator nozzle assembly 110 need only be provided with the single air fitting 146 whereby, for example, the need for three fixed-position air fitting inlet ports 44, as was the case with the hot melt adhesive applicator nozzle assembly 10, is obviated. In order to provide fluidic sealing in connection with the interfaces defined between the air fitting ring member 166 and the dispensing nozzle 112, a pair of O-ring members 168, 170 are disposed within annular recessed portions 172, 174 formed within external surface portions of the dispensing nozzle 112.

In order to complete the structural assembly of the hot melt adhesive applicator nozzle assembly 110, a substantially frusto-conically shaped swirl air disk 176 is adapted to be mounted upon the forward end tip portion of the dispensing nozzle 112, and it is seen that the swirl air disk 176 is provided with an array of circumferentially spaced swirl air apertures or passageways 178 which are adapted to be fluidically connected to the axially extending air passageways 164 defined within the dispensing nozzle 112. A substantially frusto-conically shaped end cap 152 is adapted to be mated with the swirl air disk 176 so as to effectively retain the same in its mounted position upon the forward end tip portion of the dispensing nozzle 112, and it is seen that the upstream end portion of the end cap 152 is internally threaded as at 180 whereby such threaded portion 180 is adapted to be threadedly engaged with an externally threaded portion 182 formed upon an external peripheral surface portion of the dispensing nozzle 112. The swirl air disk 176 is fabricated from a suitable brass composition, while the end cap 152 is fabricated from a suitable thermoplastic composition. It would therefore appear, for example, that as a result of the provision of the plastic end cap 152, the aforenoted potential safety or burn hazard with respect to operator personnel has been resolved, however, such is not in fact the case. It is noted, for example, that the frusto-conically shaped end cap 152 has a substantially planar front surface 184, the substantially frusto-conically shaped swirl air disk 176 likewise has a substantially planar front surface 186, and that the planar surfaces 184, 186 of the end cap 152 and swirl air disk 176 are substantially coplanar with respect to each other. Accordingly, such planar surface 186 of the swirl air disk 176 still presents a substantially large, exposed surface portion which will be heated to the aforenoted elevated temperature level of 300–400° F. and which therefore still potentially presents a substantial burn or safety hazard to operator personnel. Still further, since the swirl air disk 176 is only maintained upon the hot melt adhesive applicator nozzle assembly 110 as a result of being effectively captured or trapped between the end cap 152 and the forward end tip portion of the dispensing nozzle 112, extreme care must be taken by operator personnel when the end cap 152 is threadedly disengaged from its threaded engagement with the dispensing nozzle 112 so as not to inadvertently encounter or touch the hot swirl air disk 176.

A need therefore exists in the art for a new and improved hot melt adhesive applicator nozzle assembly wherein the assembly effectively comprises a relatively small number of component parts, wherein the air fitting is mounted within a rotatable air inlet ring member so as to automatically compensate for different angular orientation requirements of the air fitting, wherein the swirl air structure can be readily incorporated within the end cap, wherein substantially all external surface portions of the hot melt adhesive applicator nozzle assembly are fabricated from a suitable plastic material so as to effectively rid the hot melt adhesive applicator nozzle assembly of potential burn and safety hazards to operator personnel, and wherein the dispensing nozzle and swirl air structure are not externally exposed or accessible so as to likewise rid the hot melt adhesive applicator nozzle assembly of potential burn and safety hazards to operator personnel.

OBJECTS OF THE INVENTION

Accordingly, it is an object of the present invention to provide a new and improved hot melt adhesive applicator nozzle assembly.

Another object of the present invention is to provide a new and improved hot melt adhesive applicator nozzle assembly which effectively overcomes the various structural and operational drawbacks and disadvantages characteristic of the PRIOR ART hot melt adhesive applicator nozzle assemblies.

An additional object of the present invention is to provide a new and improved hot melt adhesive applicator nozzle assembly wherein substantially all external surface portions of the hot melt adhesive applicator nozzle assembly are fabricated from a suitable plastic material so as to effectively rid the hot melt adhesive applicator nozzle assembly of potential burn and safety hazards to operator personnel.

A further object of the present invention is to provide a new and improved hot melt adhesive applicator nozzle assembly wherein the swirl air structure and the dispensing nozzle are not externally exposed or accessible so as not to present potential burn and safety hazards to operator personnel.

A last object of the present invention is to provide a new and improved hot melt adhesive applicator nozzle assembly wherein the swirl air structure can be readily incorporated within the end cap such that the hot melt adhesive applicator nozzle assembly effectively comprises a relatively small number of component parts, wherein the end cap can be readily removed and replaced by operator personnel without the need for special tools, and wherein the air fitting is mounted within a rotatable air inlet ring member so as to automatically compensate for different angular orientation requirements of the air fitting.

SUMMARY OF THE INVENTION

The foregoing and other objectives are achieved in accordance with the teachings and principles of the present invention through the provision of a new and improved hot melt adhesive applicator nozzle assembly which comprises an adapter, a dispensing nozzle mounted within the adapter, a nozzle retainer threadedly engaged with the adapter for securing the dispensing nozzle within the adapter, an air inlet ring rotatably mounted upon the nozzle retainer and having an inlet air fitting fixedly mounted therein, and an end cap which is threadedly mounted upon the nozzle retainer. The end cap has swirl air passages integrally incorporated therein, and the end cap and air inlet ring are both fabricated from a suitable thermoplastic polymer material such that all exposed surfaces of the hot melt adhesive applicator nozzle assembly are plastic and are therefore at substantially lower temperature levels than the metal brass components of the hot melt adhesive applicator nozzle assembly. The external peripheral surface of the end cap is knurled so as to facilitate the manual removal of the end cap without the need for special tools, and most importantly, the dispensing tip portion of the dispensing nozzle is axially recessed with respect to the front surface of the end cap so as not to comprise a readily externally accessible surface portion. In this manner, the potential for burn and safety hazards to operator personnel has effectively been eliminated.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 2:
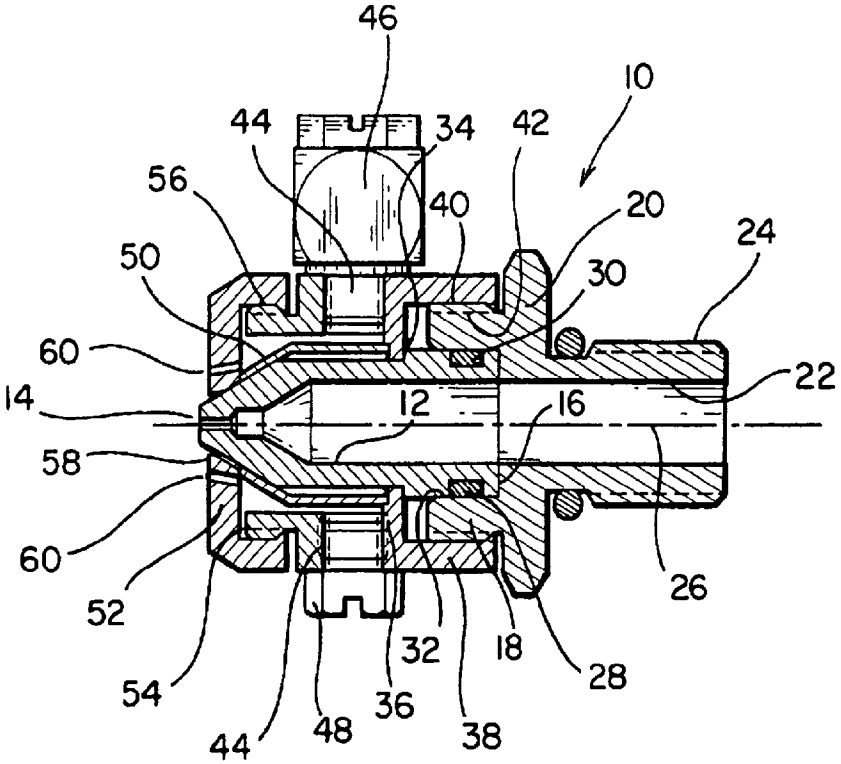
FIG. 2 (PRIOR ART)
FIG. 2 is a cross-sectional view of the first conventional PRIOR ART hot melt adhesive dispensing nozzle assembly shown in FIG. 1 and taken along the lines 2—2 of FIG. 1.
Figure 1:
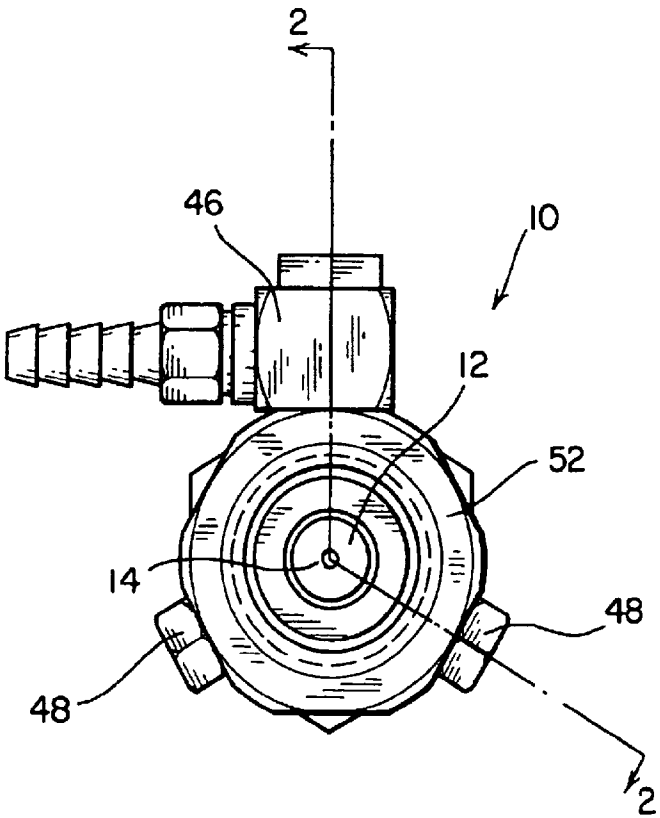
FIG. 1 (PRIOR ART)
FIG. 1 is an end elevational view of a first conventional PRIOR ART hot melt adhesive dispensing nozzle assembly.
Figure 3:
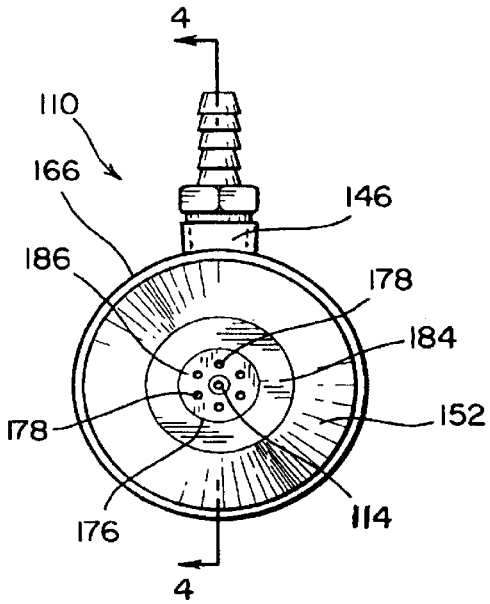
FIG. 3 (PRIOR ART)
FIG. 3 is an end elevational view of a second conventional PRIOR ART hot melt adhesive dispensing nozzle assembly.
Figure 5:
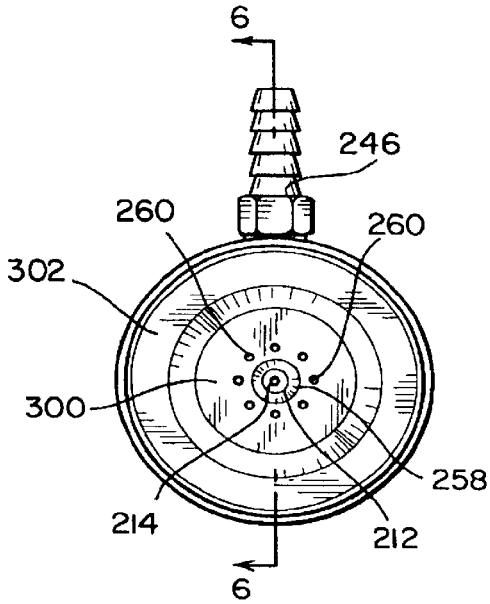
FIG. 5 is an end elevational view of a first embodiment of a new and improved hot melt adhesive dispensing nozzle assembly constructed in accordance with the teachings and principles of the present invention.
Figure 4:
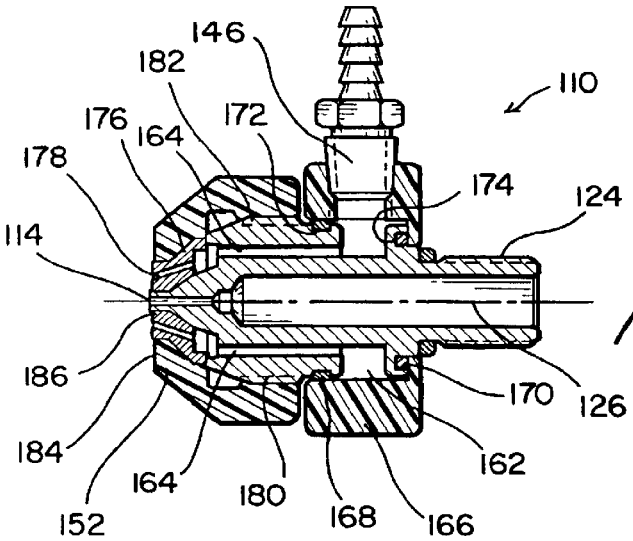
FIG. 4 (PRIOR ART)
FIG. 4 is a cross-sectional view of the second conventional PRIOR ART hot melt adhesive dispensing nozzle assembly shown in FIG. 3 and taken along the lines 4—4 of FIG. 3.
Figure 6:
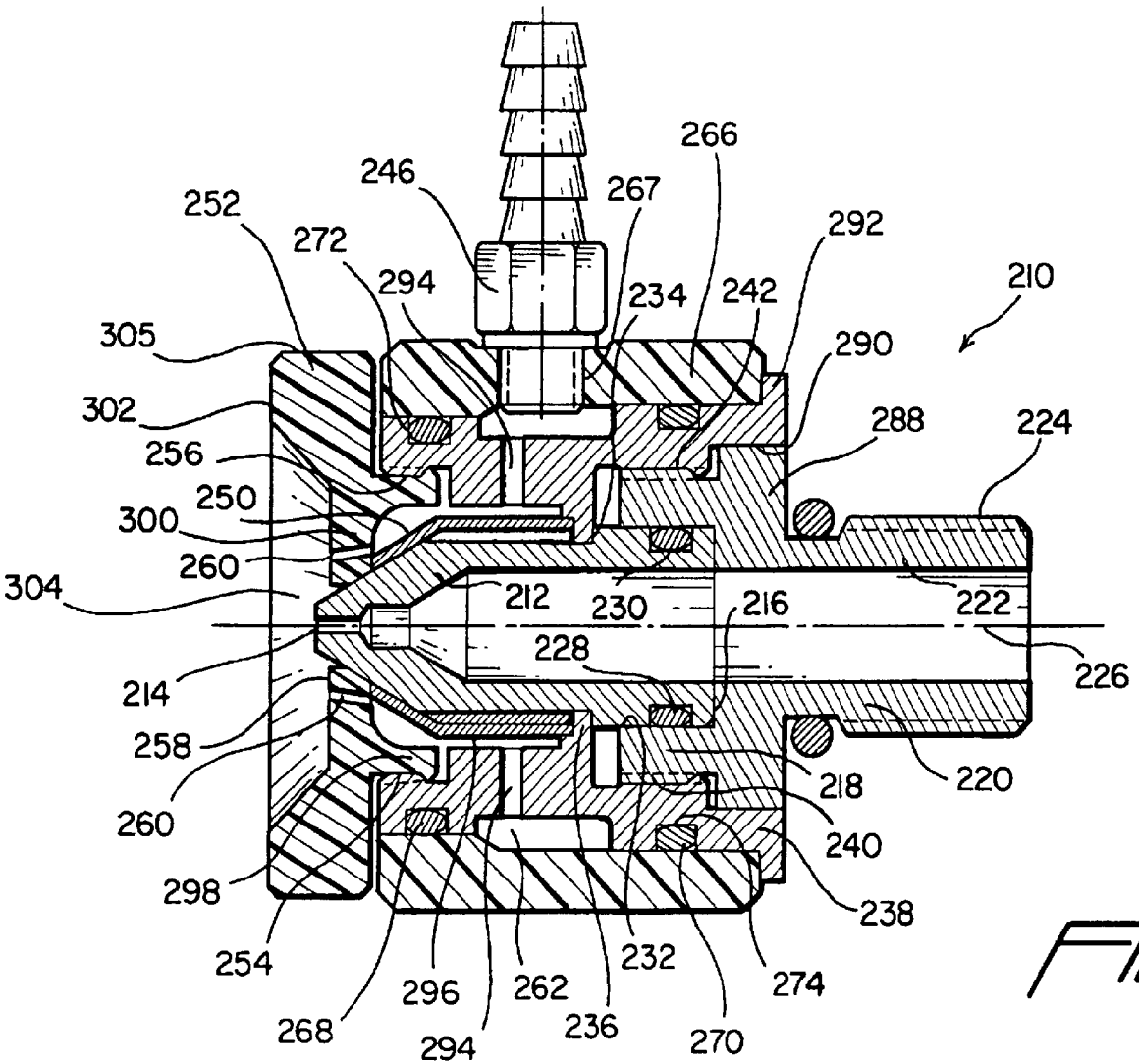
FIG. 6 is a cross-sectional view of the first embodiment of the new and improved hot melt adhesive dispensing nozzle assembly of the present invention as shown in FIG. 5 and taken along the lines 6—6 of FIG. 5.

Referring now to the drawings, and more particularly to FIGS. 5 and 6 thereof, a first embodiment of a new and improved hot melt adhesive dispensing nozzle assembly is disclosed and is generally indicated by the reference character 210. It is to be noted that in view of the fact that the first embodiment of the new and improved hot melt adhesive dispensing nozzle assembly 210 as constructed in accordance with the principles and teachings of the present invention comprises structural components which are similar to those of the well-known conventional PRIOR ART nozzle assemblies 10, 110 as disclosed within FIGS. 2 and 4, such similar or corresponding structural components will be designated by corresponding reference characters except for the fact that the reference characters will be within the 200 series. Furthermore, in view of the similarities between the first and second well-known conventional PRIOR ART hot melt adhesive dispensing nozzle assemblies 10, 110 and the first embodiment of the new and improved hot melt adhesive dispensing nozzle assembly 210 of the present invention, only those structural features of the new and improved nozzle assembly 210 which are different from those of the PRIOR ART nozzle assemblies 10, 110 will be discussed in detail. More particularly, it is to be noted that while some of the noted structural differences have been incorporated into the dispensing nozzle assembly 210 in order to spatially accommodate the integration of the various structural components of the dispensing nozzle assembly 210 of the present invention, other structural differences are significant to the basic objectives of the present invention. For example, it is initially noted that while the dispensing nozzle 212 is seated within the counterbored section 216 of the nozzle adapter 220, and is fixedly retained at such seated position by means of the radially inwardly projecting annular flanged portion 236 of the nozzle retainer 238 which is threadedly engaged with the nozzle adapter 220 as at 240, 242, the remaining structure of the nozzle retainer 238 has been altered.

More particularly, the nozzle adapter 220 has an annular flanged portion 288 which is located at an axial position interposed between its downstream threaded connection portion 242 and its upstream threaded connection portion 224, and the upstream end portion of the nozzle retainer 238 is provided with a counterbored region 290 for accommodating the flanged portion 288 of the nozzle adapter 220. In addition, the upstream end portion of the nozzle retainer 238 also comprises a radially outwardly extending flanged portion or annular lip 292 for axially confining the upstream end portion of a positionally rotatable air fitting ring member 266 which is adapted to envelop the nozzle retainer 238 in an air-tight manner through means of O-ring members 268, 270. In a manner similar to that of air fitting ring member 166 of the PRIOR ART hot melt adhesive dispensing nozzle assembly 110 of FIG. 4, the air fitting ring member 266 is provided with a single port 267 within which a single air fitting 246 is fixedly mounted. An annular recess 262 is formed within an external circumferential surface portion of the nozzle retainer 238 so as to be in fluidic communication with the air port 267 and air fitting 246, and a plurality of radially oriented bores 294 fluidically connect annular recess 262 with the annular space 296 which is defined between the inner peripheral surface of the nozzle retainer 238 and the outer peripheral surface of the dispensing nozzle 212 and within which the baffle member 250 is disposed.

Continuing still further, in lieu of the threaded connection 56 of the nozzle retainer 38 being disposed upon the external peripheral surface portion of the downstream end thereof for threaded mated connection with the end cap 52, as in the case of the PRIOR ART hot melt adhesive dispensing nozzle assembly 10, the threaded connection 256 of the nozzle retainer 238 is disposed upon an internal peripheral surface portion of the downstream end thereof. In a corresponding manner, in lieu of an end cap, such as the end cap 52 of the PRIOR ART hot melt adhesive dispensing nozzle assembly 10 having a substantially C-shaped cross-sectional configuration, the end cap 252 of the hot melt adhesive dispensing nozzle assembly 210 has a substantially disk-shaped configuration with an annular rib or wall member 298 extending axially in the upstream direction. The outer peripheral surface of the annular rib or wall member 298 is provided with a threaded connection 254 for threaded mating with the threaded connection 256 of the nozzle retainer 238, and in this manner, the end cap 252 axially confines the downstream end of the air fitting ring member 266. As has been noted hereinbefore, the dispensing nozzle 212, the nozzle adapter 220, and the nozzle retainer 238 are all conventionally fabricated from a suitable brass composition and are therefore subjected to temperature levels of between 300–400° F. The peripherally or circumferentially surrounding outer air fitting ring member 266 of the nozzle assembly 210, however, is preferably fabricated from a suitable thermoplastic material whereby it can readily be appreciated that the external periphery of the nozzle assembly 210 will not have externally exposed or accessible surface regions which are at the noted elevated temperature levels of 300–400° F. In this manner, the provision of the air fitting ring member 266 in its peripherally or circumferentially surrounding disposition or location upon the nozzle assembly 210 effectively protects operator personnel from otherwise potentially harmful burn or safety hazards. More particularly, the air fitting ring member 266 may be fabricated from a suitable polymer, such as, for example, polyetheretherketone, which is sold under the trademark PEEK™ by means of VICTREX USA INC. of West Chester, Pa.

In a similar manner, the end cap 252 is likewise preferably fabricated from the polyetheretherketone (PEEK™) polymer, and accordingly, such structure likewise protects operator personnel from encountering any potential burn or safety hazards with respect to the entire front surface region of the nozzle assembly 210. The substantially central portion 300 of the end cap 252 is provided with a plurality of substantially axially oriented swirl air passages 260 arranged within a circumferential array as best seen in FIG. 5, and in accordance with a critically important feature characteristic of the present invention, it is further appreciated that, as can best be seen from FIG. 6, the substantially central portion of the end cap 252 is axially recessed with respect to the front face or surface 302 of the end cap 252 as at 304. Accordingly, the dispensing tip portion of the dispensing nozzle 212, within which the adhesive material discharge port 214 is defined and which projects axially through the centralmost portion 258 of the end cap 252, is axially recessed with respect to the front face or surface 302 of the end cap 252 so as to further protect operator personnel from any direct exposure to those structural components, such as, for example, the dispensing nozzle 212, which will be characterized by the aforenoted elevated temperature levels of 300–400° F. It is further noted that the external peripheral surface portion 305 of the end cap 252 is preferably knurled so as to enable operator personnel to easily grasp the same and threadedly remove such component in a relatively easy manner when the particular end cap 252 requires replacement due to, for example, clogging of the swirl air passages 260, or alternatively, when it is desired to exchange end caps in order to provide different swirl air characteristics so as to achieve different adhesive deposition patterns.

Figure 7:
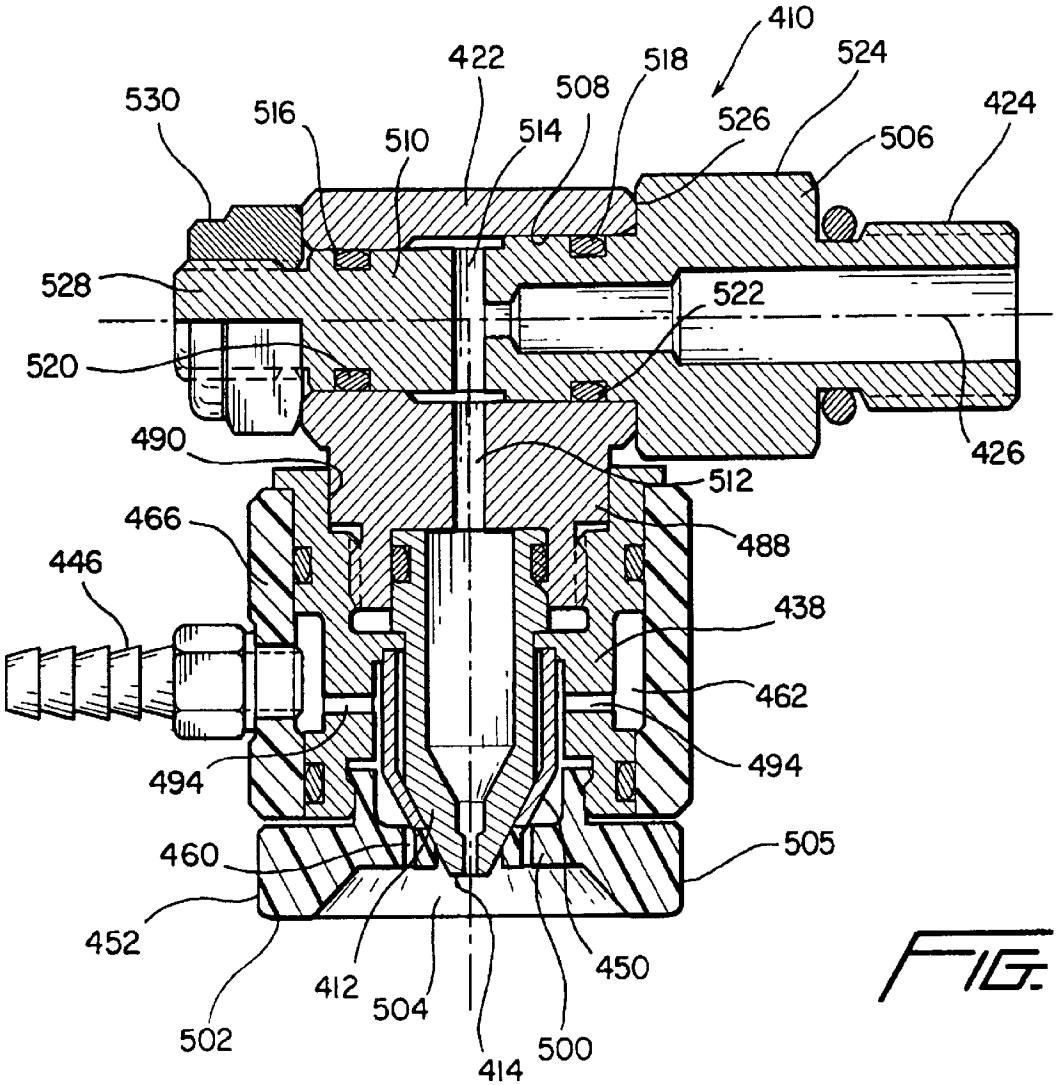
FIG. 7 is a cross-sectional view, similar to that of FIG. 6, showing, however, a second embodiment of a new and improved hot melt adhesive dispensing nozzle assembly as constructed in accordance with the principles and teachings of the present invention.

With reference lastly being made to FIG. 7, a second embodiment of a new and improved hot melt adhesive dispensing nozzle assembly, constructed in accordance with the principles and teachings of the present invention, is disclosed and is generally indicated by the reference character 410. It is to be noted that in view of the fact that the second embodiment of the new and improved hot melt adhesive dispensing nozzle assembly 410 as constructed in accordance with the principles and teachings of the present invention comprises structural components which are similar to those of the first embodiment of the new and improved hot melt adhesive dispensing nozzle assembly 210 as disclosed within FIG. 6, such similar or corresponding structural components will be designated by corresponding reference characters except for the fact that the reference characters will be within the 400 series. Furthermore, in view of the similarities between the first and second embodiments comprising the hot melt adhesive dispensing nozzle assemblies 210, 410 of the present invention, only those structural features of the new and improved nozzle assembly 410 which are different from those of the nozzle assembly 210 will be discussed in detail. More particularly, while it can be appreciated from the first embodiment nozzle assembly 210 of FIG. 6 that the passageway 226 of the nozzle adapter 220, the axial passageway within dispensing nozzle 212, and discharge port 214 are all coaxially aligned with respect to each other, to the contrary, the nozzle assembly 410 of FIG. 7 has been adapted for use in those instances wherein, for example, the axial extent of the dispensing nozzle 412 and that of the dispensing discharge port 414 are disposed substantially perpendicular to a fluid passageway 426 defined within a second or auxiliary nozzle adapter 420 which is to be mounted upon the applicator gun or similar implement, not shown.

More particularly, it is seen that the end cap 452, the air fitting ring member 466, the dispensing nozzle 412, the baffle member 450, and the air fitting 446 components of the adhesive dispensing nozzle assembly 410 of FIG. 7 are substantially identical to the corresponding components of the adhesive dispensing nozzle assembly 210 of FIG. 6, however, in order to accommodate the aforenoted perpendicular orientation of, for example, the dispensing nozzle 412 with respect to the fluid passageway 426 fluidically extending from the applicator gun or similar implement, not shown, the hot melt adhesive dispensing nozzle assembly 410 comprises additional or different structure upstream of the interface defined between the flanged portion 488 of the adapter structure and the counterbored region 490 of the nozzle retainer 438. Specifically, the single nozzle adapter 222 of the nozzle assembly 210 has effectively been replaced by means of a first or primary adapter 422 and a second or auxiliary adapter 506.

The upstream end portion of first or primary adapter 422 is provided with a transversely oriented through-bore 508 within which a stem portion 510 of the second or auxiliary adapter 506 is to be fixedly disposed. The downstream end portion of the first or primary adapter 422 is provided with an axially oriented bore 512 which is adapted to be fluidically connected to the through-bore of the dispensing nozzle 412, and the stem portion 510 of the second or auxiliary adapter 506 is likewise provided with an axially oriented through-bore 514. The through-bore 514 is adapted to be fluidically connected to the axially oriented bore 512 of the first or primary adapter 422 in a coaxial manner when the second or auxiliary adapter 506 is fixedly mounted upon the first or primary adapter 422, and the axially oriented through-bore 514 of the second or auxiliary adapter 506 is fluidically connected to the fluid passageway 426 extending from the applicator gun or other implement, not shown. A pair of O-rings 516, 518 are disposed within annular recessed regions 520, 522 of the stem portion 510 of the second or auxiliary adapter 506 so as to engage the inner peripheral surface of the transverse through-bore 508 of the first or primary adapter 422 in a fluid-tight manner. In order to fixedly secure the stem portion 510 of the second or auxiliary adapter 506 within the transverse bore 508 of the first or primary adapter 422, the second or auxiliary adapter has a radially enlarged body section 524 which defines an annular shoulder 526 for engaging one transverse side of the first or primary adapter 422, while the stem portion 510 has an externally threaded, reduced-diameter tip portion 528 upon which a nut 530 is threadedly disposed for engaging the opposite transverse side of the first or primary adapter 422.

Thus, it may be readily appreciated that in accordance with the principles and teachings of the present invention as embodied within either one of the two coaxial or perpendicular embodiments disclosed, for example, within FIGS. 6 and 7, a plastic end cap has been provided upon the discharge or dispensing end of a hot melt adhesive dispensing nozzle assembly so as to effectively protect operator personnel from otherwise accessible or exposed metal surface portions characterized by high operating temperatures. In particular, the tip portion of the dispensing nozzle is also located at an axially recessed region of the end cap so as to effectively axially offset the same from the front face or surface of the end cap. A plastic air fitting ring member also effectively covers or envelops the axial extent of the dispensing nozzle and its operatively associated nozzle retainer and nozzle adapter components so as to likewise shield operator personnel from such high-temperature metal components.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A fluid dispensing nozzle assembly for dispensing high-temperature fluids, comprising:

a fluid dispensing nozzle adapter to which a fluid, to be dispensed, is supplied;

a fluid dispensing nozzle member, disposed within said fluid dispensing nozzle adaptor, having a fluid dispensing discharge port defined within a tip portion of said fluid dispensing nozzle member;

a nozzle retainer fixedly connected to said fluid dispensing nozzle adaptor and engaged with said fluid dispensing nozzle member so as to fixedly mount said fluid dispensing nozzle member within said fluid dispensing nozzle adaptor;

an end cap comprising a substantially disk-shaped member fabricated from a thermoplastic material so as not to be heated to elevated temperatures characteristic of the high-temperature fluids being dispensed through said tip portion of said fluid dispensing nozzle member; a front face defined upon an axially downstream portion of said substantially disk-shaped member as considered in the direction in which fluid is being dispensed; means mounted upon said substantially disk-shaped member for fixedly securing said substantially disk-shaped member to said nozzle retainer; air passages defined within said substantially disk-shaped member; and a substantially axially central portion of said substantially disk-shaped member, having an aperture defined therethrough through which said tip portion of said nozzle member can project so as to dispense a fluid, axially recessed rearwardly from said front face of said substantially disk-shaped member such that when said tip portion of said nozzle member projects through said aperture, said tip portion of said nozzle member is recessed from said front face of said substantially disk-shaped member so as to protect operator personnel from being exposed to said high-temperature nozzle member; p1 an air fitting ring member rotatably mounted upon said nozzle retainer; and p1 an air fitting fluidically connected to said air fitting ring member for supplying air to said air passages defined within said substantially disk-shaped member.

2. The nozzle assembly as set forth in claim 1, wherein:

said thermoplastic material from which said end cap is fabricated comprises a polyetheretherketone (PEEK) polymer.

3. The nozzle assembly as set forth in claim 1, wherein:

said means for fixedly securing said substantially disk-shaped member to said nozzle retainer comprises an annular rib member projecting axially away from said front face of said substantially disk-shaped member and having threaded means incorporated upon an external peripheral wall surface thereof for threadedly engaging threaded means incorporated upon an internal peripheral wall surface of said nozzle retainer.

4. The nozzle assembly as set forth in claim 1, wherein:

an external peripheral surface of said substantially disk-shaped member is knurled so as to facilitate threading and unthreading of said substantially disk-shaped member from said nozzle retainer.

5. The nozzle assembly as set forth in claim 1, further comprising:

said air passages are defined within said substantially disk-shaped member at positions adjacent to said aperture defined within said substantially axially central portion of said substantially disk-shaped member, and through which said tip portion of said nozzle member can project, for providing integrated fluid flow with the fluid being dispensed by the fluid dispensing nozzle assembly.

6. The nozzle assembly as set forth in claim 1, wherein:

said air fitting ring member is fabricated from a thermoplastic material comprising a polyetheretherketone (PEEK) polymer.

7. The nozzle assembly as set forth in claim 1, wherein:

said fluid dispensing nozzle member and said fluid dispensing nozzle adaptor are coaxially aligned with respect to each other.

8. The nozzle assembly as set forth in claim 1, wherein:

said fluid dispensing nozzle member and said fluid dispensing nozzle adaptor are disposed substantially perpendicular with respect to each other.

9. The nozzle assembly as set forth in claim 1, further comprising:

means for fixedly securing said nozzle retainer upon said fluid dispensing nozzle adaptor comprises threaded means incorporated upon an internal peripheral wall surface thereof for threadedly engaging threaded means incorporated upon an external peripheral wall surface of said nozzle retainer.

10. A hot melt adhesive dispensing nozzle assembly for dispensing hot melt adhesive fluids, comprising:

a hot melt adhesive dispensing nozzle adaptor to which a hot melt adhesive, to be dispensed, is supplied;

a hot melt adhesive dispensing nozzle member, disposed within said hot melt adhesive dispensing nozzle adaptor, having a hot melt adhesive dispensing discharge port defined within a tip portion of said hot melt adhesive dispensing nozzle member;

a nozzle retainer fixedly connected to said hot melt adhesive dispensing nozzle adaptor and engaged with said hot melt adhesive dispensing nozzle member so as to fixedly mount said hot melt adhesive nozzle member within said hot melt adhesive dispensing nozzle adaptor;

an end cap comprising a substantially disk-shaped member fabricated from a thermoplastic material so as not to be heated to elevated temperatures characteristic of the high-temperature hot melt adhesive materials being dispensed through said tip portion of said hot melt adhesive dispensing nozzle member; a front face defined upon an axially downstream portion of said substantially disk-shaped member as considered in the direction in which hot melt adhesive material is being dispensed; means mounted upon said substantially disk-shaped member for fixedly securing said substantially disk-shaped member to said nozzle retainer; air passages defined within said substantially disk-shaped member; and a substantially axially central portion of said substantially disk-shaped member, having an aperture defined therethrough through which said tip portion of said nozzle member can project so as to dispense hot melt adhesive material, axially recessed rearwardly from said front face of said substantially disk-shaped member such that when said tip portion of said nozzle member projects through said aperture, said tip portion of said nozzle member is recessed from said front face of said substantially disk-shaped member so as to protect operator personnel from being exposed to said high-temperature nozzle member;

an air fitting ring member rotatably mounted upon said nozzle retainer; and an air fitting fluidically connected to said air fitting ring member for supplying air to said air passages defined within said substantially disk-shaped member.

11. The nozzle assembly as set forth in claim 10, wherein:

said thermoplastic material from which said end cap is fabricated comprises a polyetheretherketone (PEEK) polymer.

12. The nozzle assembly as set forth in claim 10, wherein:

said means for fixedly securing said substantially disk-shaped member to said nozzle retainer comprises an annular rib member projecting axially away from said front face of said substantially disk-shaped member and having threaded means incorporated upon an external peripheral wall surface thereof for threadedly engaging threaded means incorporated upon an internal peripheral wall surface of said nozzle retainer.

13. The nozzle assembly as set forth in claim 10, wherein:

an external peripheral surface of said substantially disk-shaped member is knurled so as to facilitate threading and unthreading of said substantially disk-shaped member from said nozzle retainer.

14. The nozzle assembly as set forth in claim 10, further comprising:

said air passages are defined within said substantially disk-shaped member at positions adjacent to said aperture defined within said substantially axially central portion of said substantially disk-shaped member, and through which said tip portion of said nozzle member can project, for providing integrated swirl air flow with the hot melt adhesive material being dispensed by the hot melt adhesive dispensing nozzle assembly.

15. The nozzle assembly as set forth in claim 10, wherein:

said air fitting ring member is fabricated from a thermoplastic material comprising a polyetheretherketone (PEEK) polymer.

16. The nozzle assembly as set forth in claim 10, wherein:

said fluid dispensing nozzle member and said fluid dispensing nozzle adaptor are coaxially aligned with respect to each other.

17. The nozzle assembly as set forth in claim 10, wherein:

said fluid dispensing nozzle member and said fluid dispensing nozzle adaptor are disposed substantially perpendicular with respect to each other.

18. The nozzle assembly as set forth in claim 1, wherein:

said fluid dispensing nozzle member has a longitudinal axis; and said air fitting ring member is rotatably mounted upon said nozzle retainer so as to be rotatable around said longitudinal axis of said fluid dispensing nozzle member.

19. The nozzle assembly as set forth in claim 1, further comprising:

air passageway means defined within said nozzle retainer for fluidically supplying air from said air fitting to said air passages defined within said substantially disk-shaped member.

20. The nozzle assembly as set forth in claim 10, further comprising:

means for fixedly securing said nozzle retainer upon said fluid dispensing nozzle adaptor comprises threaded means incorporated upon an internal peripheral wall surface thereof for threadedly engaging threaded means incorporated upon an external peripheral wall surface of said nozzle retainer.

21. The nozzle assembly as set forth in claim 10, wherein:

said fluid dispensing nozzle member has a longitudinal axis; and said air fitting ring member is rotatably mounted upon said nozzle retainer so as to be rotatable around said longitudinal axis of said fluid dispensing nozzle member.

22. The nozzle assembly as set forth in claim 10, further comprising:

air passageway means defined within said nozzle retainer for fluidically supplying air from said air fitting to said air passages defined within said substantially disk-shaped member.

* * * * *